US007380428B2

(12) United States Patent
Morehart et al.

(10) Patent No.: US 7,380,428 B2
(45) Date of Patent: Jun. 3, 2008

(54) SEPARABLE TRANSPONDER KEY ASSEMBLY

(75) Inventors: Gary Morehart, Rocky Mount, NC (US); Ron Crisafulli, Rocky Mount, NC (US); Doug Davis, Rocky Mount, NC (US)

(73) Assignee: Kaba Ilco Corp., Rocky Mount, NC (US)

( * ) Notice: Subject to any disclaimer, the term of this patent is extended or adjusted under 35 U.S.C. 154(b) by 0 days.

(21) Appl. No.: 11/299,346

(22) Filed: Dec. 12, 2005

(65) Prior Publication Data

US 2007/0137269 A1 Jun. 21, 2007

(51) Int. Cl.
*E05B 19/04* (2006.01)

(52) U.S. Cl. ..... 70/395; 70/278.3; 70/408

(58) Field of Classification Search ..... 70/408, 70/278.2, 278.3, 278.7, 395, 413; 340/5.61–5.66, 340/10.1, 572.8, 5.72; 341/173, 176
See application file for complete search history.

(56) References Cited

U.S. PATENT DOCUMENTS 4,287,735 A 9/1981 Brunken et al.
4,516,000 A * 5/1985 Ryberg et al. ..... 200/302.1
5,156,032 A * 10/1992 Edgar ..... 70/278.3
5,383,345 A * 1/1995 Kallinger-Prskawetz-Jacobsen ..... 70/395
5,433,096 A 7/1995 Janssen et al.
5,632,168 A * 5/1997 Yano ..... 70/278.3
5,727,408 A 3/1998 Mizuno et al.
5,768,925 A * 6/1998 Ozawa et al. ..... 70/408
5,775,148 A * 7/1998 Layton et al. ..... 70/408
5,819,564 A * 10/1998 Watanuki ..... 70/278.2
5,878,611 A * 3/1999 Lerchner et al. ..... 70/276
5,974,844 A * 11/1999 Harrelson et al. ..... 70/408
6,016,676 A * 1/2000 McConnell ..... 70/408
6,035,677 A * 3/2000 Janssen et al. ..... 70/278.3
6,164,101 A * 12/2000 Kito et al. ..... 70/278.3
6,427,504 B1 * 8/2002 Janssen et al. ..... 70/278.3
6,637,245 B1 * 10/2003 Bolton ..... 70/408
6,862,908 B2 * 3/2005 Seki ..... 70/408
6,948,344 B2 9/2005 Janssen
2003/0000267 A1 * 1/2003 Jacob et al. ..... 70/399
2003/0051520 A1 * 3/2003 Janssen et al. ..... 70/278.3
2003/0159481 A1 * 8/2003 McGuire et al. ..... 70/408
2005/0229662 A1 * 10/2005 Banks ..... 70/278.3

FOREIGN PATENT DOCUMENTS

JP 4-6462 * 1/1992

OTHER PUBLICATIONS www.jetkeys.com, "Transponder Technology from JET, Clone the Unclonable," cover page website.
www.silca.it, "Silica, Electronic Key Plus," 3 page printout from website.
Silica Brochure cover page, "Sicla Electronic Key".

* cited by examiner

*Primary Examiner*—Lloyd A Gall
(74) *Attorney, Agent, or Firm*—The Hill Firm; Dennis A. Gross

(57) ABSTRACT

A transponder key assembly is provided with a key blade and head assembly, with the head formed with a transponder holder opening therein from a face of the head and a separable transponder carrier matingly configured to the opening and adapted to be received into and be removable from the opening so as to prevent separation of the transponder from the key blade and head assembly to preserve the transponder for use in a subsequent key blade and head assembly.

11 Claims, 1 Drawing Sheet

SEPARABLE TRANSPONDER KEY ASSEMBLY

BACKGROUND OF THE INVENTION

This invention relates to keys, and more particularly to transponder equipped keys.

BACKGROUND

Keys equipped with transponders have become common for use in certain lock security environments. One common current use is in automobile ignition systems where the lock is associated with an electronic recognition system, which communicates with a transponder carried by the key upon insertion of the key into the lock. Only in those instances where the transponder returns a coded signal matching the code information associated with the lock will the rotation of the key in the lock be permitted to activate the vehicle's engine.

In addition to having the transponder, however, the key is normally provided with the standard key-lock mechanical interfacings such as milling and bitting cuts required to allow the key to rotate the actuating portion or cylinder of the lock.

Therefore, in order to duplicate a key for such a key-lock combination, the duplicate key must be provided both with the required key blade configuration, i.e. milling, bitting, length or similar physical attributes, which are compatible with the corresponding mechanical security features of the lock, and the key must be provided with a transponder coded appropriately for that particular locking system.

It is a normal practice is the manufacture of such transponder carrying keys to provide a holder or other device for securing the transponder with respect to the metal key blade, generally in the region of at least a partial metal head. The partial metal head and holder as well as, in some instances, proximal portions of the key blade adjacent the head are then overmolded in one or more steps to secure the holder in place in the key head, now including the overmolded portion, in a secure fashion. Such overmolding provides protection to the transponder without substantially interfering with the signal functoinability of the transponder. Such transponder-molded head key assemblies are shown, for example, in U.S. Pat. Nos. 5,433,096; 5,632,168; 5,974,844; and 6,948,344.

It is known that transponders may take different shapes and be constructed of different materials having different dimensions thereby requiring or benefiting from the use of different dimensioned holders adapted to properly received to the transponder. Since one type of transponder is generally associated with one type of key recognition electronics, the transponder type imbedded in the key head must be matched to the transponder type required by the locking system with which it is intended to be used. Since it is also common for such locking systems to employ different millings and blade lengths for the key blank-cylinder slot interface, it is also therefore necessary for the key assembly to have a milling of the key blade which matches the opening of the lock. This multiplicity of millings, transducers and other features requires the availability of a large number of different key assemblies. This requirement for an after market key dealer, such as a locksmith, to maintain a fairly large inventory of transponder equipped keys can require a significant investment since the transponder equipped keys are quite expensive in comparison to non-transponder equipped keys.

SUMMARY OF THE INVENTION

This invention seeks to overcome disadvantages in the prior art by providing a two-piece head assembly incorporating a plastics material molded head with a receptacle therein for receipt of a separately molded or manufactured holder adapted to receive a transponder. By configuring the receptacle in the head related to a particular type of transponder and by utilizing different shaped holders which will mate with the different shaped receptacles, with each holder having the ability to receive a particular type of transponder, key blanks consisting of differently shaped blades with a common receptacle shaped head can be stacked independently of the transponders and their appropriately shaped holders.

The holders are designed to be securely affixable within the recess and in a preferred embodiment removable from the recess either by application of specialized tools or by other mechanical manipulation. In this manner, a transponder associated with the key can be removed from the key blank and utilized in another appropriate key blank, thus saving the expense of the transponder, for example, when a key is miscut or when it is desired to change the lock configuration by re-keying the lock which would require having a substitute key having different bittings. Discarding of the old key would no longer result in the necessity to discard a transponder.

In an embodiment of the invention, a key blank comprising a blade, which may be formed of metal, which is molded in place in a molded plastics material key head which is provided with a configured attachment area for receipt of a separate transponder holder whose configuration mates with the configuration of the attachment area, the holder having an area for carrying a particular style of transponder.

In an embodiment of the invention, a key blank is provided having a blade secured to a molded head having a configured recess in a face thereof, the recess configuration chosen to mate with a matingly configured transponder holder, wherein the configurations are related to a particular transducer type, and wherein the holder has an opening therein for receipt of that particular transducer type, to the exclusion of at least some other transducer types and wherein at least one of the head recess and holder have securing devices effective to retain the holder in the recess.

In an embodiment of the invention retention devices carried by the transponder holder secure the holder in position in the recess or opening in the molded key head automatically upon insertion of the holder into the recess or opening.

In an embodiment of the invention the retention devices securing the holder in the recess or opening of the key head are releasable in a simple fashion to permit removal of the holder from the key head.

In a further embodiment of the invention, the holder is provided with an opening therein for selective receipt of at least one specific type of transponder while excluding receipt of other types of transponders and wherein the opening is provided with a retention device for retaining the transponder in the opening, the retention device being disengageable to allow insertion and removal of the transponder.

These features and other objects of the invention will be apparent from a description of the preferred embodiments thereof, it being understood that the illustrated embodiments are merely examples of some form in which the invention may be practiced, and it may be apparent to those of ordinary skill in the art that different elements, combinations of elements, features, shapes, sizes, and locations are readily selectable.

DESCRIPTION OF THE PREFERRED EMBODIMENTS

Figure 1:
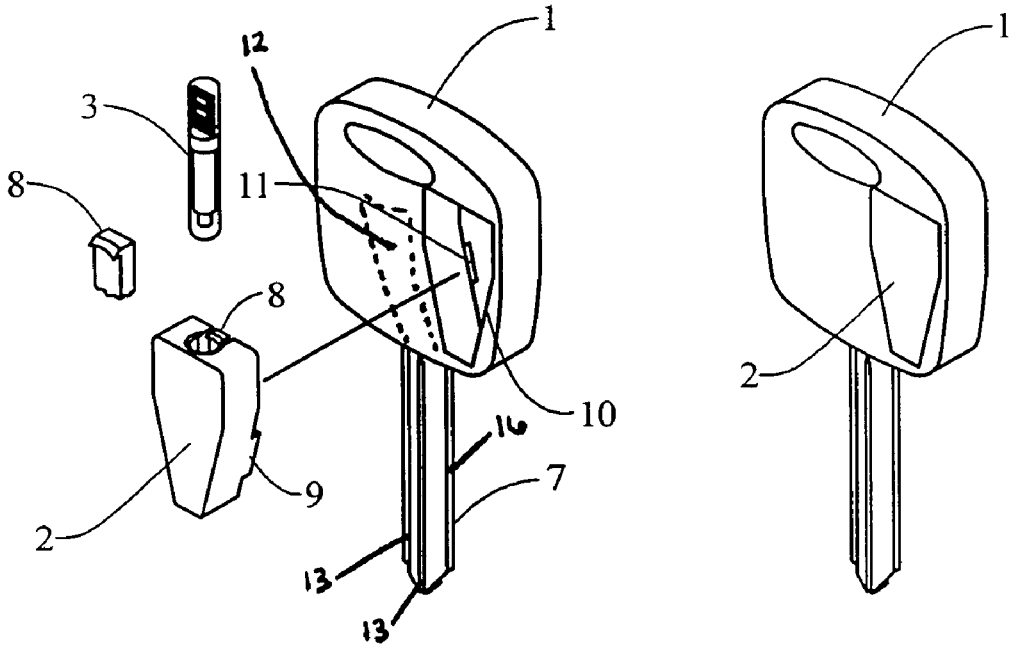
FIG. 1 is an exploded and an assembled view of a transponder equipped key blank.

As shown in FIG. 1, a key blank may include a head 1 and a blade 7 projecting from the head. As is well known in the art, the head 1 may be formed as a plastic or plastics material molding around a proximal end 12 of the key blade. The proximal end may be shaped as desired to appropriately secure the key blade 7 in the head and, as is known in the art, may be solid, provided with openings or having legs or other projections and configurations that cooperate with the molded head to secure the blade to the head against blade movement independent of the head in all orthogonal directions including rotation.

As is common, the blade is equipped with millings 13 that extend the length of the blade and which cause a cross-section configuration of the blade to exist which will allow the blade to be inserted only into a cylinder slot having an appropriately shaped opening. Although the preferred embodiments illustrated show what are sometimes referred to as flat blade keys, these are by way of example only and it is to be understood that the term "blade" as used herein includes other lock interfacing shapes such as circular, elliptical, hollow cylindrical, winged, and other known variations used to properly control entry of the key blade into the key blade reception area of a lock.

The key head is provided with a transponder 3 designed to interface with the locking system. Although the term transponder is used in this application, it will be appreciated that there are a large variety of electronic and/or magnetic interfacing devices that act in association with sensing members or circuitry associated with the lock to properly identify the key to that lock. Current prevailing technology is REID technology where an electric pulse from the lock associated circuitry energizes a transponder in the key to allow the key to transmit a code signal received by a sensor associated with the lock circuitry. If the received code matches one or more of the stored codes in the lock sensing circuitry, the key can be said to be recognized by the lock and the lock then authorized to be activated. It will be understood that the term transponder as used herein is intended to cover all such contact free signaling devices positionable within the head of a key for the purpose of activating a lock associated sensor circuitry whereby the lock and key can be matched to one another.

In the embodiment shown in FIG. 1, the transponder 3 is a standard glass enclosed generally cylindrical transponder of a type currently commonly employed in automotive keying systems. The key head 1 is provided with a recess 10 which preferably may be a blind recess having a back wall but which may also be an opening extending through the key head. The term "recess" as used herein applies to both blind recess and through openings. The recess 10 is provided with a certain chosen shape, in this instance a tapering rectangular shape having parallel sided upper portions and tapering sided lower portions and generally flat top and bottom boundary walls. A transponder holder 2 is provided having an opening therein for receipt of the transponder 3. The opening, shown in this instance as being a tubular opening extending from a top surface may be dimensioned to snugly receive the transponder 3 and may have a snap lock 8 formed to secure the transponder in the holder 2. In the embodiment illustrated, the snap lock 8 consists of a resilient finger, which may be molded integrally with the holder 2 and which terminates at its top, adjacent the top of the holder 2 with an in-turned lip. The transponder 3 may be inserted into the opening in the holder by displacing the finger 8 to allow the transponder to pass the in-turned lip, whereupon the resiliency of the finger 8 will cause the lip to partially overlie an end of the transponder maintaining the transponder in the opening. It will be appreciated that although the transponder could be otherwise secured in the holder, the use of a securing device such as the resilient finger 8 allows for removability of the transponder in a relatively simple fashion.

Figure 2:
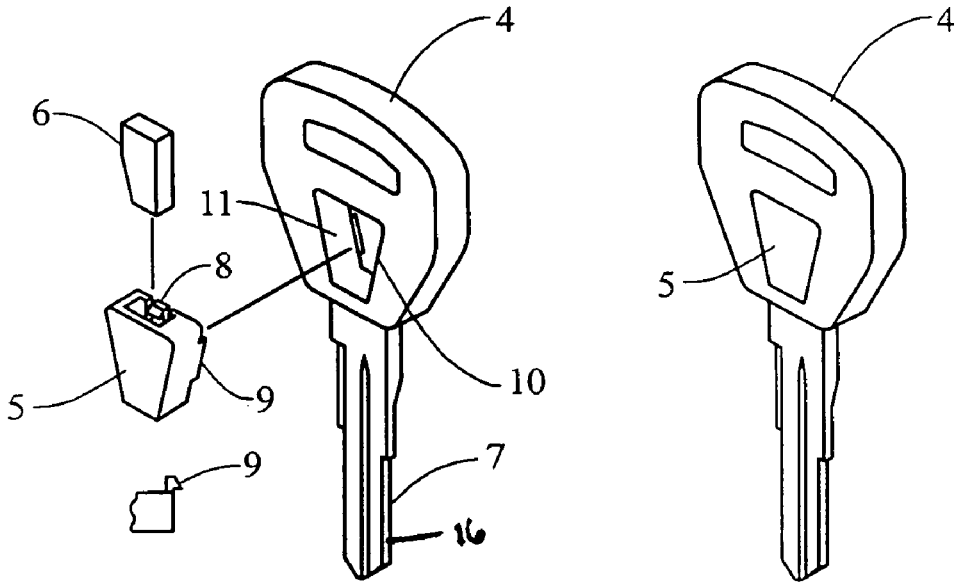
FIG. 2 is a view similar to FIG. 1 showing a second variant of the transponder key blank in exploded and assembled views.

The holder 2 is also provided with securing devices 9 which mate with mating security devices 11 in the recess 10 to hold the holder 2 in the recess. The securing devices 9 and 11 may, for example, consist of opposed resilient lips somewhat similar to the lip on the finger 8 which, when the holder 2 is fully inserted in the recess 10, will cause the lips to overlap, thereby locking the holder in the recess. Alternatively, only one of the securing devices 9 or 11 may consist of a resilient lip piece with the other providing a groove into which the lip may snap upon full insertion. As shown in FIG. 2, the lip 9 on the securing device may extend outwardly so as to project into a groove in the sidewall at the bottom of the recess, or in those instances where the recess 10 is an opening, may extend to the backside of the head and overlie a portion of the backside or reside in a depression bounding the opening and generally dimensioned to receive the lip.

Preferably, the mating securing devices 9 and 11 are releasable either through the use of specially designed release tools which will overcome the resiliency of one or both of the members or through tools as simple as the blade of a screw driver being wedgable between the housing and the sidewall of the recess. Other release mechanism devices are well known and may, for example, include devices such as a small opening in the opposite face of the key head, which may or may not be covered by a plug, and which can receive a probe or tool which will disengage the securing devices.

In the preferred embodiment, the securing devices are automatically actuated upon insertion of the holder into the recess 10 into its fully seated position. For this reason, resilient snap-like members, such as are illustrated in FIG. 2, are preferable since they provide a secure mechanical interlock while allowing relatively easy intentional disassembly. In a preferred embodiment, the securing devices 9 and 11 will allow removal of the holder 2 from the recess without damage of the holder or its associated securing device such that the holder is then reusable in another key blank. The choice of securing device to be chosen for a given holder-head combination can, in part, be determined with respect to the properties of the material of the holder and of the head. For example, with a holder formed of relatively harder material than the head, the holder may be formed with peripheral dimples and the head opening or recess formed with mating side wall recesses for receipt of the dimples whereupon the holder may simply be pushed into the head until the dimples and side wall recesses are engaged. In such a construction the holder can then be pushed out of the other side of the head by application of a force, either by tool or, in the event of a through opening, by hand pressure sufficient to overcome the head material's resistance to deformation. While a reversal in hardness between head and holder achieving similar results is contemplated, in general the holder should have a strength sufficient to provide protection to the transponder such that neither insertion nor removal of the holder would cause excessive pressure damage to the transponder.

As shown in FIG. 2, the holder 5 and the recess 10 may be differentially configured, for example in comparison to the holder 2 and recess 10 of FIG. 1, to distinguish a different transponder. FIG. 2 illustrates a transponder 6 of the type currently used known as a wedge transponder. The opening in the holder for receipt of the wedge transponder 6 will be correspondingly shaped to the transponder 6 and again will be provided with a holding member 8.

It will be appreciated that there are a number of different transponder types available and that an individual lock will generally only work with its corresponding type of transponder. By differentially configuring the holders and the recesses, it can be assured that the proper type of transponder is associated with the proper key for that particular lock. Since it is common for manufacturers of devices having secure locking systems utilizing transponders to utilize a plurality of different millings or lengths or combination thereof for the locking systems which may all employ the same transponder type, the use of an insertable and removable properly configured holder will allow a locksmith or the like to inventory a large range of key blanks having different millings or key lengths or key shapes or combinations thereof which may all employ the same type of transducer. Such key blanks can be provided with a common shaped recess although the key blade will differ. The number of transponders required to be kept in stock will therefore be considerably less than the number of key blanks.

Additionally, keys are provided with key blade edges 16 which are cut to match the internal lock configuration. For example, a common locking system utilizes tumbler pins which must be elevated from a rest position to a specific elevated position which may differ for each pin in a series of pins in the lock. For this reason the edge 16 is cut having different elevations or bits, with the different elevations elevating different pin stacks. As discussed above, a known problem is that duplicating an existing key can often result in a miscutting of the bits such that the cut key will not properly activate the lock. In such instance, the key normally needs to be discarded and another duplicate cut. The use of the removable holder allows the locksmith to simply discard a miscut key blank without loss of the transponder. It will be appreciated that because many key duplication cuttings are provided to replace a worn key, or because of the desire to have a different shaped key head, that the removable holder described herein can allow for simple substitution of an existing transponder associated with the original key into a new key either utilizing the same holder, in those instances where the holder can be removed from the existing key without damage to the holder, and where the new key head has an identically shaped receptacle for the holder, or simply by removing the transponder from the old holder, inserting it into the new holder and inserting the new holder into the key.

Upon completion of a new or duplicate key, the key head, at least in the area of the holder, can be covered, as desired, for example with a stick-on decorative logo sticker or medallion.

When cutting a new or duplicate key, depending on the particular lock system utilized, it may be unnecessary to insert the transponder holder until after the bitting of the new key has been tested in the lock inasmuch as certain locks will rotate on the insertion of a properly milled and bitted key, although that rotation will not accomplish full activation of the lock. For example, in automotive usages rotation of the lock with a key not having the proper transponder may fail to send a signal to the ignition system. In such instances the holder and transponder can be affixed to the key after the proper bitting has been tested.

It will be understood that the particular shape chosen for the holder, and therefore for the key recess or opening, may be varied as desired. In certain instances it may be desired to provide the outside face of the holder with design features, identification features, or identification logos which may include features of shape. It will be further appreciated that although in the preferred embodiment illustrated the openings for receipt of the transponder in the holder are shown as being in a side wall of the holder, in those instances where the opening in the key head is a blind recess rather than a thru hole, the opening in the holder for receipt of the transponder may be through the back face of the holder with one or more securing devices formed as a portion of the back face to retain the transponder in the holder.

Although this invention has been shown and described with respect to certain preferred embodiments, it is to be understood that these are by way of illustration only and others may wish to practice this invention in different embodiments or with modification of the illustrative features. For example, given a thick enough key head the opening 10 could be provided in a side face of the key head rather than a front or back face.

We claim:

1. Keys having an insertable transponder holder comprising:

Keys having a key blade molded to and carried by a molded plastics material key head, the key head having a recess in an outer face thereof, the recess of each key head having a first chosen configuration selected from a number of different configurations, a separate transponder holder having a second chosen configuration mateable with and insertable into the recess's first chosen configuration selected from a number of configurations, interengaging securing portions on at least one of the holder and head effective to releasably retain the holder in the recess upon insertion of the holder into the recess, the holder having a receptacle for receiving a transponder, a transponder positioned within the receptacle, and the holder having a second securing portion retaining the transponder in the receptacle.

2. The keys of claim 1 wherein the first and second chosen configurations are different for different keys which are associated with different types of transponders whereby an incorrect type of transponder cannot be inserted in its holder into the key head recess.

3. The keys of claim 2 wherein the interengaging securing portions are releasable to allow the holder to be removed from the head.

4. The keys of claim 3 wherein the second securing portion is releasable allowing the transponder to be removed from the receptacle.

5. The keys of claim 4 wherein the securing portions and the second securing portion include a resilient portion.

6. The keys of claim 1 wherein the recess extends through the head having openings on opposite faces of the head.

7. The keys of claim 1 wherein the recess is a blind recess.

8. The method of matching a transponder to a key blank comprising the steps of:

a. providing a plurality of different types of transponders, b. providing a plurality of different types of key blanks, each having a molded plastic head with a shaped recess in a face thereof and a blade extending from the head, c. providing a plurality of transponder holders, each having an opening therein for receipt of a transponder, d. configuring different ones of the plurality of holders with different shapes, e. providing the holders with openings shaped to receive one type of transponder while precluding receipt of at least some other type of transponders, f. configuring the shaped recess in the heads with different configurations adapted to receive different shaped holders whereby only holders adapted to receive transponders of a type appropriate for a given key type can be properly received in the recess of that key type, g. providing at least one of the holders and key heads with at least one securing portion engageable with the other of the holder and key head effective to releasably and removably secure the holder in the recess upon insertion of a correctly shaped holder into the recess;

h. selecting a key from among the plurality of keys appropriate for use in a given lock, i. selecting a holder having a configuration complementary to the recess configuration of the selected key, j. selecting a transponder appropriate for insertion into the opening in the selected holder, k. inserting the transponder into the selected holder, and l. securing the selected holder in the recess of the selected key.

9. The method of claim 8 wherein the at least one securing portions securing the holder in the recess is selectively releasable to allow separation of the holder from the recess after securing the holder in the recess without damage to the transponder.

10. A transponder key comprising: a key blank having a metal key affixed to a molded plastic material head having an exterior face, a recess in said face having a predetermined configuration, a separate transponder holder having a configuration complementary to and insertable into the recess, the holder having a recess therein configured to receive at least one particular type of transponder, a transponder received in the recess in the holder, the holder having a releasable securing portion for removably securing the transponder in the holder recess, and the holder and head having engageable securing portions for removably securing the holder in the recess in the head, the head recess configuration, the holder configuration and the holder recess configuration being related to one another such that transponders appropriate for use with a selected key blank may be inserted into the holder, and the holder inserted into the key head recess whereas at least some transponders not suitable for use with the key blank are prevented from either being insertable into the holder, or the holder insertable into the head recess or both.

11. A transponder key combination comprising: a key blank having a key blade affixed to and carried by a molded plastics material key head, the key head having an exterior face thereof having a recess therein, the recess having a selected configuration, a transponder holder formed separately of the key head, the transponder holder having a configuration compatible and mateable with the recess upon insertion of the holder into the recess, the holder adapted to carry a transponder, and the holder and the head having interengageable and disengageable securing portions effective to releasably secure the holder in the recess, a transponder carried by the holder, securing portions associated with the holder releasably securing the transponder in the holder.

* * * * *